United States Patent [19]

Werner

[11] Patent Number: 4,592,175

[45] Date of Patent: Jun. 3, 1986

[54] MODULAR HABITATION STRUCTURE

[75] Inventor: William J. Werner, Butler, Pa.

[73] Assignee: Werner Metal Industries, Inc., Ford City, Pa.

[21] Appl. No.: 615,123

[22] Filed: May 30, 1984

[51] Int. Cl.[4] ..... E04H 3/00

[52] U.S. Cl. ..... 52/79.9

[58] Field of Search ..... 52/79.9, 262, 79.1

[56] References Cited

U.S. PATENT DOCUMENTS

| | | | |
|---|---|---|---|
| 1,777,879 | 10/1930 | Ewertz | 52/262 |
| 1,778,889 | 10/1930 | Disbro | 52/262 |
| 1,995,573 | 3/1935 | Matthews | 52/79.9 |
| 2,078,011 | 4/1937 | Neher | 52/262 |

FOREIGN PATENT DOCUMENTS

| | | | |
|---|---|---|---|
| 1500966 | 10/1967 | France | 52/79.1 |
| 366144 | 1/1963 | Switzerland | 52/262 |
| 677727 | 8/1952 | United Kingdom | 52/262 |

*Primary Examiner*—John E. Murtagh

*Attorney, Agent, or Firm*—Paul Bogdon

[57] ABSTRACT

A modular habitation structure such as would be used in constructing a multi-room, multi-story building is disclosed. The modular structures includes floor framing formed from sections of structural support members such as steel channel beams securely interconnected to define the outline of a desired room shape. Upright sheet metal wall panels are fixed at their respective lower ends to the support members and at their respective height dimensions to each other to define the side enclosures of the room. A ceiling member of the same construction as the wall members is rigidly fixed to the upper portions of each of the wall members. The wall members, floor framing and ceiling are constructed and arranged and interconnected with each other to form a unitary, integral construction having a vertical load bearing capacity of a predetermined value greater than the weight of one completely constructed room and lateral force bearing capacity above a predetermined value. The modular habitation structure by itself is capable of providing support of any number of similar units attached one on top of the other.

7 Claims, 7 Drawing Figures

MODULAR HABITATION STRUCTURE

BACKGROUND OF THE INVENTION

This invention relates to a new and improved modular habitation structure of the type used in the construction or erection of a multi-room, multi-story building.

The use of pre-fabricated modular habitation structures or units has been tried for many past years using various construction materials and designs. Modular unit building construction has been desirable because of the continuing rise in construction costs of conventional buildings. Many and varied designs of modular units have resulted. None, however, have been simple, and virtually all have required elaborate and expensive structures to support more than two stories of building. In most instances the less complex modular unit designs are capable of use in forming one or two story buildings. Also, the modular units used for high rise building construction, as well as requiring additional structural steel frame work, have been designed such that they required interior finishing and furnishing at the building site.

This invention overcomes the inherent drawbacks, both those mentioned above and others, of the heretofore known and tried modular habitation structures. My invention is very simple in construction using panels rigidly fastened to a base or floor frame to form walls, and another panel rigidly secured to the walls. The floor frame, walls, and ceiling form an integrated, unitary construction having a vertical load bearing capacity not heretofore known or considered by designers of modular units. Each structure of my invention thus forms, in effect, a building block which is capable of supporting multi-units of my invention. No other support structures are required when using my modular habitation structure in forming multi-room, multi-story buildings. My invention permits simple stacking and bolting together of side to side and top to bottom units. Also, my modular habitation structure may be provided at the factory with a finished and furnished interior, flooring, plumbing, electrical service, heating units, and the like. The units may be virtually completely pre-fabricated, shipped to the construction site, installed and secured in place, electrical, water, and sewer services connected, and thereafter be ready to be occupied.

SUMMARY OF THE INVENTION

My present invention provides a novel modular habitation structure such as would be used for multi-room multi-story building construction, which structure is capable of supporting by itself, a large number of stacked units. The modular habitation structure of this invention, in its preferred form, includes floor framing having a plurality of securely interconnected support members defining a desired room outline; upright sheet, preferably metal, wall members fixed at their respective lower ends to the support members and rigidly fixed at their respective height dimensions to each other to define side enclosures of a room; and a ceiling member rigidly fixed to upper portions of each of the wall members. The wall members, the floor framing, and the ceiling members are constructed and arranged and interconnected with each other such that a unitary, integrated construction is formed having a vertical load bearing capacity of a predetermined value preferably much greater than that of the weight of one completed unit. Also, the components are constructed and arranged with respect to each other such that the completed unit has a lateral force bearing capacity above a predetermined value. Preferably the components of my modular habitation structure are formed of steel with the wall and ceiling members being similarly formed of a single sheet having structure reinforcing members rigidly fixed on them or of abutting panel units defining spaced structural reinforcing members on their outer surfaces. Means are provided for bolting together side to side and top to bottom stacked units to form a multi-room, multi-story building. Thus, my modular habitation structure is, in effect, a building block for forming buildings such as jails, hotels, motels, apartments, schools, hospitals, and the like, without the need of elaborate structural steel framing. My modular structure is capable of being formed in any desired function such as living quarters, water closets, storage units, shower rooms, elevator shafts, stairwells and the like.

Various other advantages, details, and modifications will become apparent as the following description of a present preferred embodiment proceeds.

DESCRIPTION OF THE DRAWINGS

In the accompanying drawings, I show a present preferred embodiment of this invention and a typical application of its use, in which.

DESCRIPTION OF A PREFERRED EMBODIMENT

Figure 1:
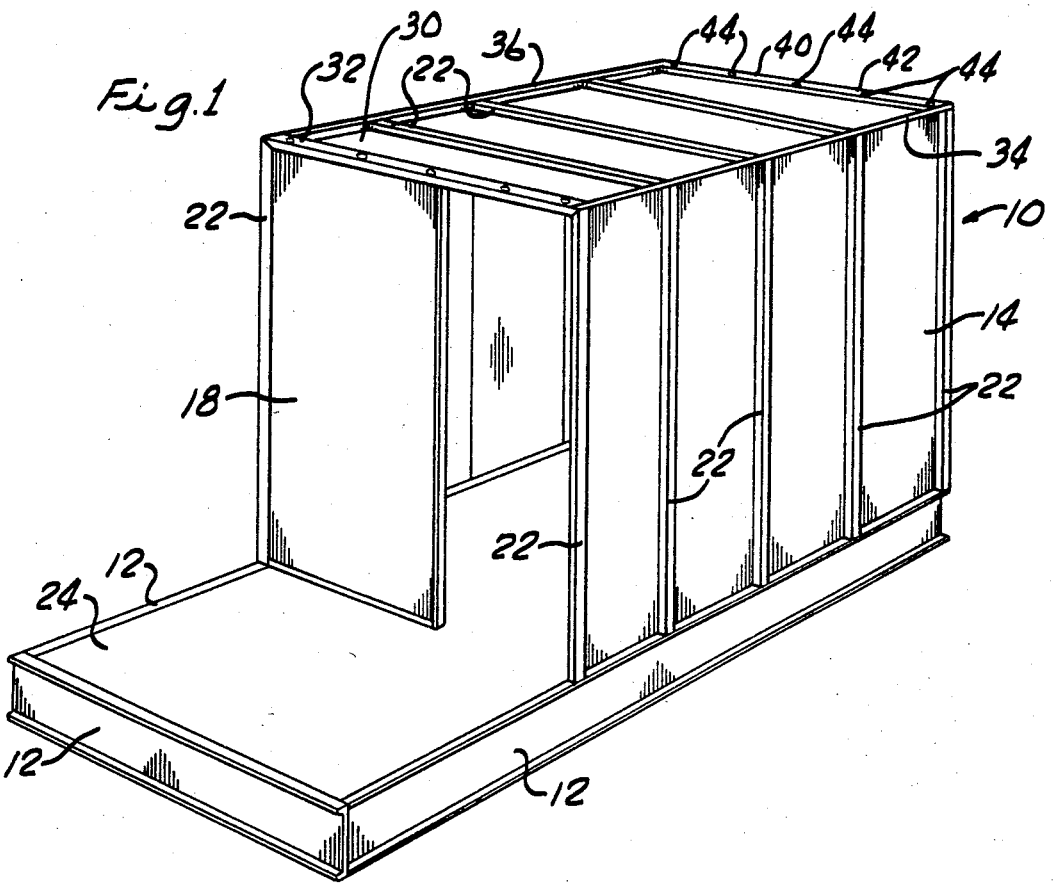
FIG. 1 is a perspective view of a modular habitation structure embodying my present invention.
Figure 2:
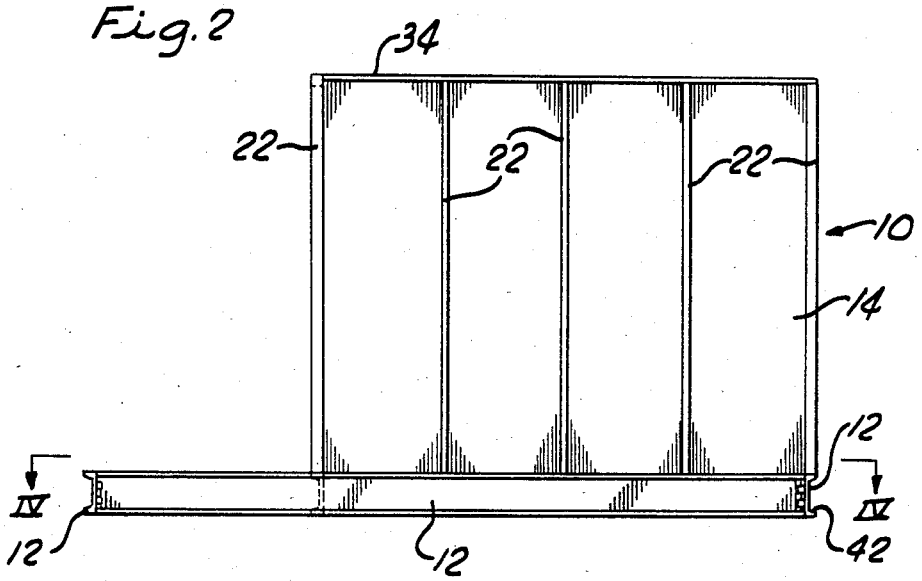
FIG. 2 is a side elevation view of the structure of FIG. 1.

Referring now to the drawings, FIGS. 1 through 5 illustrate one embodiment of a single modular habitation structure or, as will be referred to from time-to-time in this description, modular unit 10. The modular unit 10 includes a floor framing formed of four interconnected support members such as steel structural channel beams 12. The beams 12 are rigidly interconnected by suitable means such as by welding. Upright, rigid side wall members 14 and 16, front wall member 18, and rear wall member 20 are rigidly secured at their respective lower ends to the channel beams 12 by suitable means such as by welding. Each wall member 14, 16, 18, and 20 is formed from suitably sized sheet steel having a thickness of anywhere between 5/64 inch and 3/16 inch depending on the desired vertical and lateral loan bearing capacity of the entire modular unit 10, as will become more apparent later on in this description. Rigid tubular structural reinforcing members 22 are vertically secured as by welding to the side wall members 14 and 16 and to the rear wall member 20. As will be clearly shown in FIG. 5, the rear wall member 20 is secured along its side height dimensions to side wall members 14 and 16 by welding together the reinforcing members 22 which are respectively parts of the rear ends of side wall members and sides of the end wall member. The side wall members 14 and 16 are secured along their respective front end height dimensions to the front wall member 18. As clearly shown in FIGS. 1 and 4, the front wall member 18 is secured, as by welding, along its side height dimensions to reinforcing members 22 which form the front ends of the side wall member 14 and 16. As just described the wall members 14, 16, 18, and 20, are rigidly secured to each others to form side enclosures of a room, the pattern of which is defined by the floor frame comprised of the interconnected channel beams 12. A floor 24 of any suitable construction is formed within the confines of the floor frame defined by the interconnected channel beams 12. Front wall member 18 is provided with a doorway 26 and rear wall member 20 is provided with a window 28.

Figure 3:
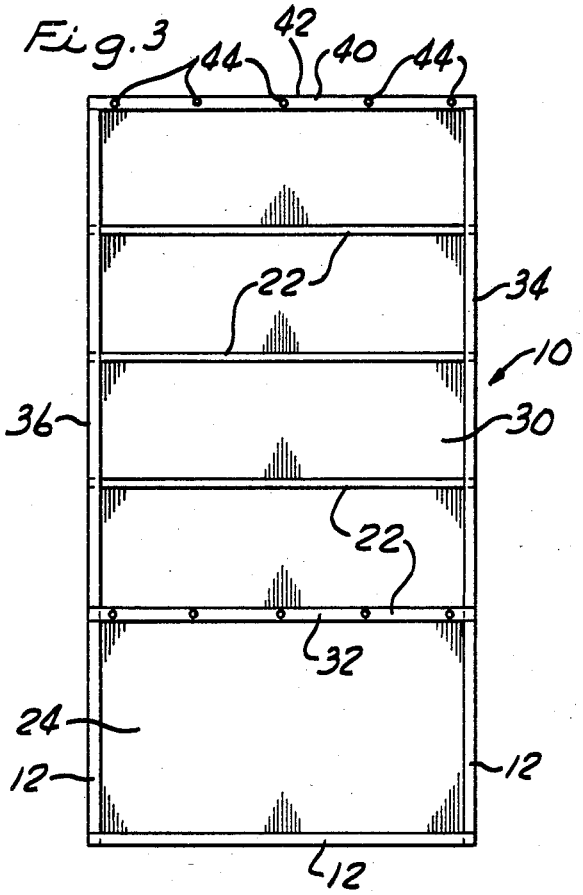
FIG. 3 is a plan view of the structure of FIG. 1.
Figure 4:
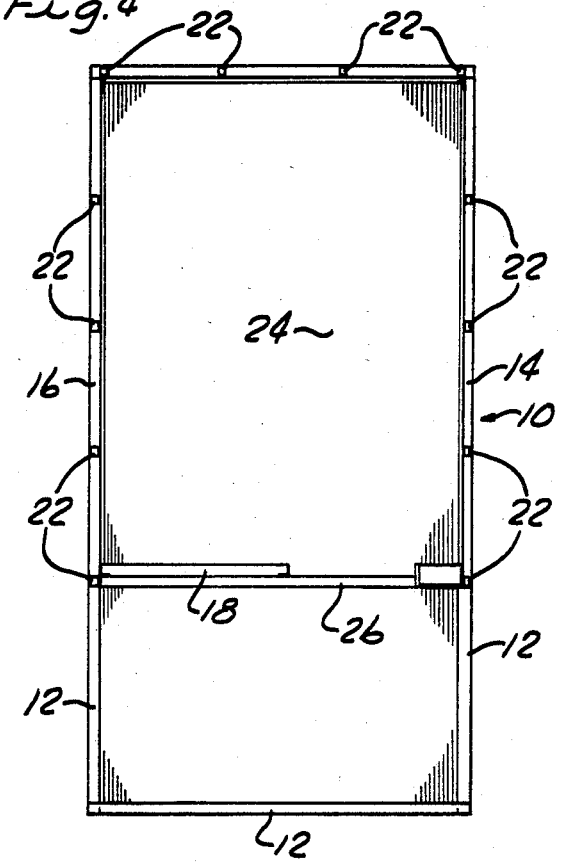
FIG. 4 is a view looking along the line IV—IV of FIG. 2.
Figure 5:
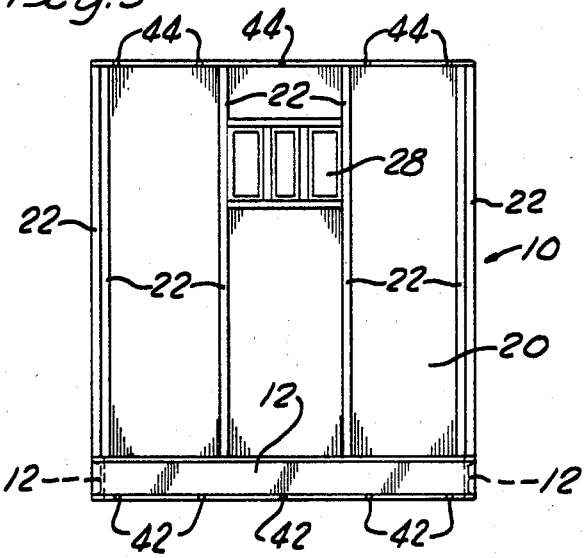
FIG. 5 is a rear elevation view of the structure of FIG. 1.

A ceiling member 30 is secured as shown in FIGS. 1 and 3, to upper portions of each of the side wall members 14 and 16, front wall member 18, and rear wall member 20. The ceiling member 30 is formed similarly to the wall members of sheet steel with tubular structural reinforcing members 22 being secured as by welding to the sheet steel. The ceiling member 30 is also secured to the wall members as by welding. A reinforcing member 32 is also provided at the front end of the ceiling member 30. The reinforcing member 32 is welded to the plate of the ceiling member 30, with that same reinforcing member 32 being welded at its opposite ends to the upper ends of the front reinforcing members 22 of the side wall members 14 and 16. Side plates 34 and 36 are secured as by welding to the upper ends of the reinforcing members 22 of the side wall members 14 and 16. An end plate 40 is similarly welded to the upper ends of the reinforcing members 22 of the end wall member 20, as clearly shown in FIG. 5. Although not clearly shown, the opposite ends of the reinforcing members 32 of the ceiling member 30 abut the upper end portions of the reinforcing members 22 of the side walls members 14 and 16 respectively.

The construction and arrangement of the floor framing formed of the channel beams 12, the side wall members 14 and 16, the front and rear wall members 18 and 20, and the ceiling member 30, and the respective interconnections of the floor framing and members, together with the strength properties of the component, results in a unitary, integrated construction of the modular unit 10 which has a vertical load bearing capacity sufficient to support a plurality of units 10 stacked one on top of another. In other words, a single modular unit 10 of this invention has a vertical load bearing capacity for supporting a plurality of similar units 10 vertically stacked to form a multi-story construction.

As stated above, modular units 10 may be stacked on top of one another. Also, units 10 may be abutted side by side to one another. Bolt holes 42 are provided through the channel beam 12 forming the rear end of the floor framing. Bolt holes 44 are also provided through the rear plate 40, with the bolt holes 42 being spaced such that they align with bolt holes 44 when one modular unit is stacked on another. Bolts may be passed through the bolt holes 42 and 44 and secured by nuts to thereby secure one modular unit 10 stacked on another. Similarly, as shown in FIG. 6, side plates 50 may be secured to the end sections of the rear channel beam 12 of this floor framing, with the side plates being provided with bolt holes positioned to align with bolt holes in the rear channel beam of an adjacent modular unit 10, so that securing bolts may be threaded to secure together side by side units 10.

The unitary, integrated construction of the modular unit 10 as described also provides a desired lateral force capacity which is needed to resist forces which would be realized from wind, for example.

Figure 6:
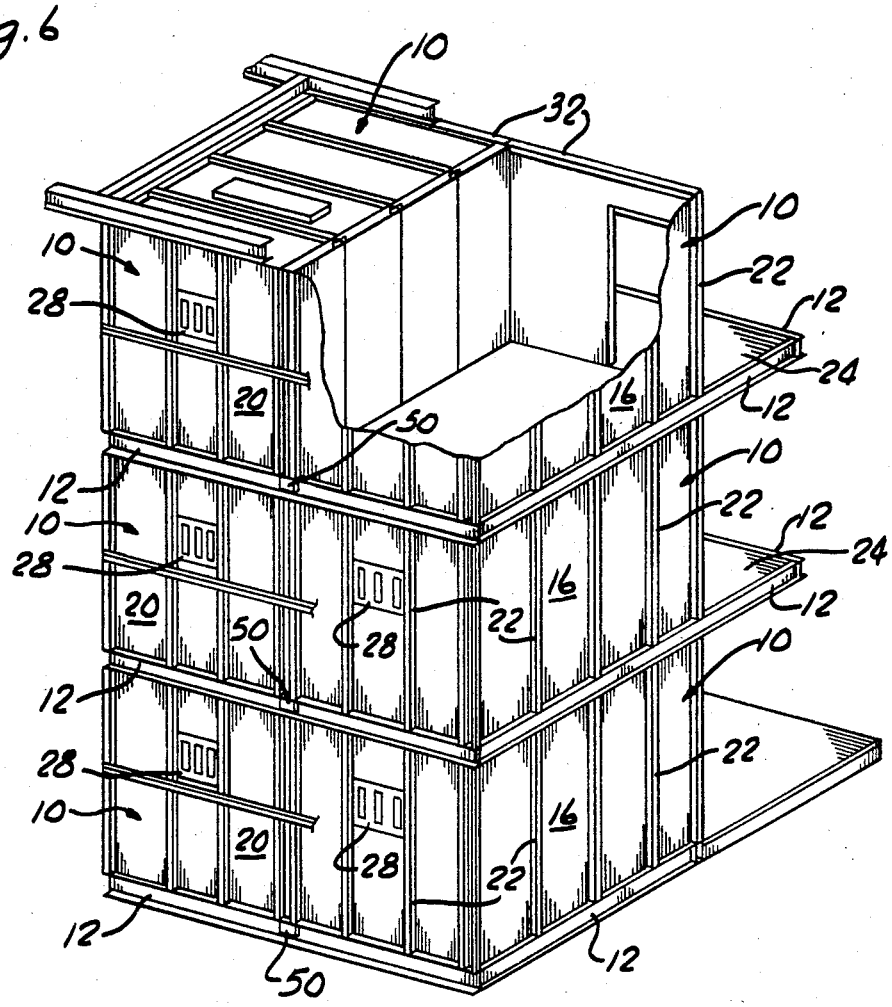
FIG. 6 is a perspective view with parts cut away showing a partial construction of a building using modular habitation structures of this invention.

FIG. 6 illustrates a partial building construction using side-by-side and one-on-top-of-another stacked modular units 10. In constructing such a multi-unit, multi-story building, the first story modular units 10 are placed side-by-side on a foundation or substructure. The second story units 10 will then be simply stacked directly on top of the first story units and bolted to them. Each additional story is formed by adding units 10 to the lower ones. No other building materials or framing structures, other than the modular units 10 themselves, are needed to construct and erect the multi-story building. As stated previously, the modular unit 10 of the invention is, in effect, a building block for constructing a building. The significant distinction between an ordinary building block and this invention is that the modular unit 10 contains a habitable, useable interior.

In the construction and design of buildings where floor space is required between stories the modular units 10 may be simply shaped so that they can support the floor system and floor joists such that the floor may be secured to any of the walls of the units 10. Any span or open space between modular units 10 forming the building may be provided by any number of conventional ways.

When the top story of modular units 10 has been placed, a structure may be placed on the tops of the units to provide a roof system covering all area of the building. The total weight of the roof system would be supported by the assembly of modular units 10. There may also be secured to the peripheral modular units 10 any desired facades, such as brick veneer, aggregate or custom architectural steel panels, formed steel sheeting, glass and the like. Elevator shafts, stairwells, and other such components having the same combination of elements as the modular units 10 described, may also be constructed in developing and erecting a complete building.

It should now be clearly understood how the modular habitation structure 10 of my present invention provides those advantages recited in the introductory portion of this specification. There are other advantages of the invention. The modular units 10 may be constructed faster and more economically than conventional structures. Also, the construction of my modular units 10 is for permanent use as compared with many modular designs which are for short term use. In addition, because of the strength characteristics of my modular unit 10 it is ideally useable in areas subject to seismic incidents. My modular units 10 are also ideally suitable for jail and prison construction where such structures may be erected at a considerable cost savings over conventional prison construction. Suffice it to say that my modular unit 10 has building capabilities limited only by the creativity of the architects and designers who would apply my invention to their creations.

Figure 7:
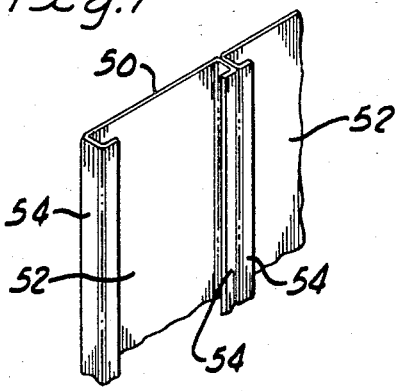
FIG. 7 is a perspective view of a wall member of the modular habitation structure of the invention showing a variation of construction from the wall members of the previous Figures.

FIG. 7 shows just one of many possible modifications of my invention. There is shown in FIG. 7 a part of a wall member 50 which is formed by a plurality of panels 52 having generally C-shaped side sections 54. The panels 52 are abutted at their side sections 54 and secured to each others by welding. The side sections 54 provide the desired structural reinforcement for the overall wall member 50. Wall member 50 may be used as a side wall, front or rear wall, or ceiling member.

As noted earlier, the modular unit 10 of my invention may be completely interiorly finished and furnished at the factory prior to shipping to the construction site. Heating and air conditioning may be provided to accord with desired specifications. Any needed piping and ducting may be installed in a mechanical chase that would be an integral part of the unit 10. Piping for water and waste, together with electrical services, may also be installed within the mechanical chase. Radiant heating piping may be installed in the floor or heating radiators installed on the walls.

Each modular unit 10 may be constructed and arranged to bear a vertical load of a desired magnitude. A typical vertical load bearing capacity of my modular unit 10 would be 500,000 pounds.

While I have shown a present preferred embodiment on this invention, it is to be distinctly understood that the invention is not limited thereto, but may be otherwise variously embodied within the scope of the following claims.

I claim:

1. A modular habitation structure for use in a multistory building having more than two such structures stacked one on top of another, each of said structures comrpising:

rigid floor framing having a plurality of securely interconnected support members defining a desired room outline;

upright rigid sheet wall members fixed at their respective lower ends to said support members and rigidly fixed at their respective height dimensions to each other to define side enclosures of a room;

a rigid ceiling member rigidly fixed to upper portions of each of said wall members;

said wall members and said ceiling member having a plurality of abutting panels rigidly secured to each other, said panels having end sections defining generally C cross-section shapes with said panels being secured to each other at the end sections whereby integral structural reinforcing members are defined by adjacent, abutting end sections;

connections means for rigidly connecting said ceiling member to said floor framing of another completely constructed said room stacked on top of a lower said room;

securing means for rigidly securing a completely constructed said room to an adjacent said room;

holding means for securing walkways, elevator shafts, and other building components to said floor frames; and said wall members, said floor framing, said connection means, said securing means, said holding means, and said ceiling member having vertical and lateral strength properties and being constructed and arranged and interconnected with each other such that all said members, floor framing, connecting means, securing means and holding means have a unitary integrated construction with a vertical load bearing capacity of a predetermined value more than that of the weight of two or more completely constructed said rooms and a lateral force bearing capacity above a predetermined value;

said wall members being further constructed and arranged with respect to said floor framing and said ceiling member such that said wall members will mate with wall members of adjacent completed said rooms; and said ceiling member being further constructed and arranged with respect to said wall members such that said ceiling member will mate with the underside of a said floor frame of a complete said room stacked on top of said ceiling member.

2. A modular habitation structure as set forth in claim 1 wherein said floor framing, wall members, and ceiling member are formed of metallic material.

3. A modular habitation structure as set forth in claim 1 including weld means rigidly fixing said floor framing, wall members, and ceiling member into an interconnected unitary structure.

4. A modular habitation structure as set forth in claim 1 wherein said wall members and said ceiling members are substantially identically constructed.

5. A modular habitation structure as set forth in claim 1 including a plurality of spaced structural reinforcing members fixed to the surfaces of said wall members and said ceiling member.

6. A modular habitation structure as set forth in claim 1 including window means and door means defined in said wall members; and heat insulation means supported by at least said wall members.

7. A modular habitation structure as set forth in claim 1 including end attachment means in said floor framing for attachment of said room side-to-side with another room constructed similarly to said room; and including upper and lower attachment means on said floor framing and said wall members for attachment of said room on top of another room constructed similarly to said room.

* * * * *